US008137064B2

(12) United States Patent
Takemoto et al.

(10) Patent No.: US 8,137,064 B2
(45) Date of Patent: Mar. 20, 2012

(54) FAN APPARATUS

(75) Inventors: Shinji Takemoto, Kyoto (JP); Hideaki Konishi, Shiga (JP)

(73) Assignee: Nidec Corporation, Kyoto (JP)

( * ) Notice: Subject to any disclaimer, the term of this patent is extended or adjusted under 35 U.S.C. 154(b) by 1087 days.

(21) Appl. No.: 11/762,100

(22) Filed: Jun. 13, 2007

(65) Prior Publication Data

US 2007/0286724 A1 Dec. 13, 2007

(30) Foreign Application Priority Data

Jun. 13, 2006 (JP) ..... 2006-163085

(51) Int. Cl.
*F04D 29/54* (2006.01)

(52) U.S. Cl. ..... 415/211.2

(58) Field of Classification Search ..... 415/208.3, 415/209.3, 211.2, 220
See application file for complete search history.

(56) References Cited

U.S. PATENT DOCUMENTS

| | | | | |
|---|---|---|---|---|
| 6,024,536 | A * | 2/2000 | Tsubakida et al. | 416/189 |
| 6,045,327 | A * | 4/2000 | Amr | 415/211.2 |
| 6,244,818 | B1 | 6/2001 | Chang | |
| 6,398,492 | B1 * | 6/2002 | Cho et al. | 415/191 |
| 7,052,236 | B2 * | 5/2006 | Chang et al. | 415/191 |
| 2005/0008494 | A1 | 1/2005 | Tsuchiya et al. | |
| 2006/0002790 | A1 | 1/2006 | Lu et al. | |
| 2006/0045736 | A1 | 3/2006 | Lee et al. | |
| 2007/0253814 | A1 | 11/2007 | Lee et al. | |

FOREIGN PATENT DOCUMENTS

| | | | |
|---|---|---|---|
| JP | 10-205497 | A | 8/1998 |
| JP | 2003-003999 | A | 1/2003 |
| JP | 2004-300934 | A | 10/2004 |
| JP | 2006-063968 | A | 3/2006 |
| JP | 2007-278104 | A | 10/2007 |

* cited by examiner

*Primary Examiner* — Nathaniel Wiehe
(74) *Attorney, Agent, or Firm* — Keating & Bennett, LLP

(57) ABSTRACT

A fan apparatus includes an impeller, a motor rotating the impeller, a plurality of stator blades arranged opposite to the impeller in an axial direction. The stator blades each include a curved portion at which the stator blades each are curved with respect to the direction in which the stator blades extend.

17 Claims, 7 Drawing Sheets

FAN APPARATUS

BACKGROUND OF THE INVENTION

1. Field of the Invention

The present invention relates to a fan apparatus having a stator blade.

2. Description of Related Art

In recent years, as the capacities of electronic equipment are enhanced, the amount of heat emitted by internal components of the electronic equipment is increased. In order to control the increase in the temperature inside the electronic equipment, a fan apparatus is used.

There are mainly two types of functions of the fan apparatus. They are: (a) to discharge heated air within the electronic component out of a housing accommodating the electronic component, and (b) to provide cool air directly to the heat emitting component within the electronic equipment in order to reduce the temperature of the electronic component. In order to achieve the function (a) above, the fan apparatus is required to have high air flow rate and high static pressure, and to achieve the function (b), efficiency in wind speed distribution is required beside the high air flow rate and high static pressure. Hereinafter, what is meant by the wind speed distribution is a characteristic which defines a distribution of air flow discharged from an air outlet of the fan apparatus. Note that a degree of quietness is also an important element for both functions (a) and (b).

According to a fan apparatus in general, when an air flow is discharged from the air outlet, the air flow spreads, due to centrifugal force of the rotation of an impeller, in a radial direction with respect to the impeller. However, it is important that the air flow is directed at portions which emit heat in order to increase the cooling efficiency of the fan apparatus.

In general, the fan apparatus includes the housing formed by using a mold for resin molding. Hereinafter, a general method for manufacturing the housing made by the resin molding will be described. The mold used for the resin molding includes a fixed mold portion and a sliding mold portion. When the fixed mold portion and the sliding mold portion are combined with one another, a space will be created therebetween having substantially the same shape as the shape of that which is formed by the mold. The sliding mold portion is slid toward the fixed mold portion, and resin is provided to the space created therebetween. After the resin is formed in accordance with the space between the sliding mold portion and the fixed mold portion, the resin is removed therefrom. As shown in FIG. 7, in a method as described above, when the sliding mold portion is removed from the fixed mold portion, the sliding mold portion is removed in a direction as indicated with an arrow A3. Therefore, an excessively bulging portion will be generated inevitably at a portion corresponding to an upper portion of an inclined portion 4*a* in the A3 direction. Although if a mold having a sliding portion which slides in an A1 direction shown in FIG. 7 is used, the problem concerning the excessively bulging portion 6 may be reduced, the cost for the manufacturing the housing will be increased, which may be problematic.

As described earlier, improving the efficiency of the air flow and the degree of quietness are critical for the fan apparatus having a stator blade.

Also, the excessively bulging portion generated due to the configuration of the housing including the stator blade is problematic in that the excessively bulging portion has an influence on the flow quantity of the air flow, distribution of the air flow and the degree of quietness of the fan apparatus. Therefore, it is critical how the influence of the excessively bulging portion is controlled.

SUMMARY OF THE INVENTION

In order to overcome the problems described above, preferred embodiments of the present invention provide a fan apparatus having an improved air flow quantity, wind speed distribution, and degree of quietness.

Also, preferred embodiments of the present invention provide a fan apparatus that controls the influence of the excessively bulging portion generated due to the configuration of the housing including the stator blade.

According to a preferred embodiment of the present invention, a fan apparatus includes an impeller, a motor operable to rotate with respect to a central axis in a concentric manner with the impeller, a plurality of stator blades arranged in substantially a radial direction opposite from the impeller in an axial direction, and a support portion connected to the stator blades. The stator blades each include a curved portion extending in the radial direction, and a direction in which each stator blade extends is altered at the curved portion thereof along a hypothetical surface that is substantially perpendicular to the axial direction.

Also, a preferred embodiment of the present invention provides a fan apparatus having an impeller operable to, when the impeller rotates, take in air from one end of an axial direction and discharge the air from the other axial end, a motor operable to rotate in a concentric manner with the impeller with respect to the central axis, a housing including an outer frame portion surrounding the impeller, a support portion arranged at the axial end to support the motor, and a plurality of stator blades arranged in a radial direction opposite from the axial end. Each of the stator blades is arranged to connect the support portion and the outer frame portion, and a portion at which the stator blade and the support portion are connected to one another is inclined toward a direction of the rotation of the impeller.

Other features, elements, steps, characteristics and advantages of the present invention will become more apparent from the following detailed description of preferred embodiments thereof with reference to the attached drawings.

DETAILED DESCRIPTION OF PREFERRED EMBODIMENTS

Figure 1:
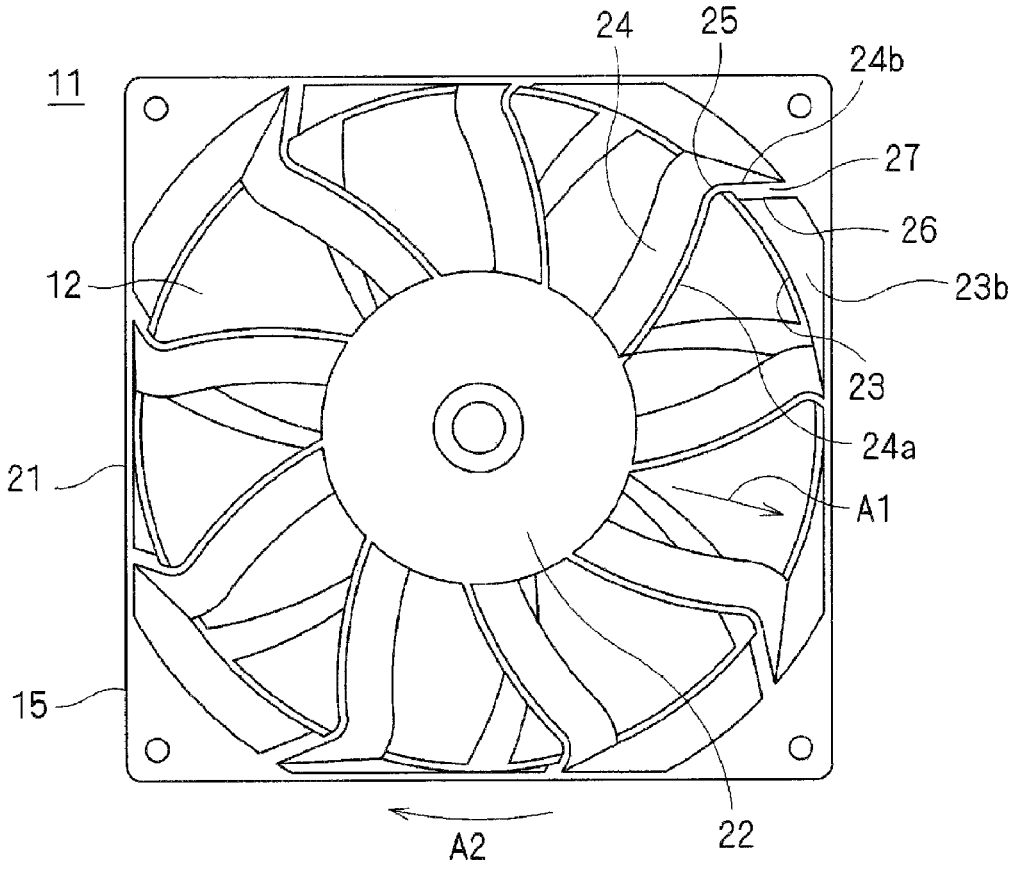
FIG. 1 is a schematic plan view of a fan apparatus according to a preferred embodiment of the present invention.

Hereinafter, preferred embodiments of a fan apparatus according to the present invention will be described. Note that in the description of the preferred embodiments of the present invention herein, words such as upper, lower, left, right, upward, downward, top, and bottom for describing positional relationships between respective member and directions merely indicate positional relationships and directions in the drawings. Such words do not indicate positional relationships and directions of the member mounted in an actual device. Also, note that reference numerals, figure numbers and supplementary descriptions are shown below for assisting the reader in finding corresponding components in the description of preferred embodiments below to facilitate the understanding of the present invention. It should be understood that these expressions in no way restrict the scope of the present invention.

Figure 2:
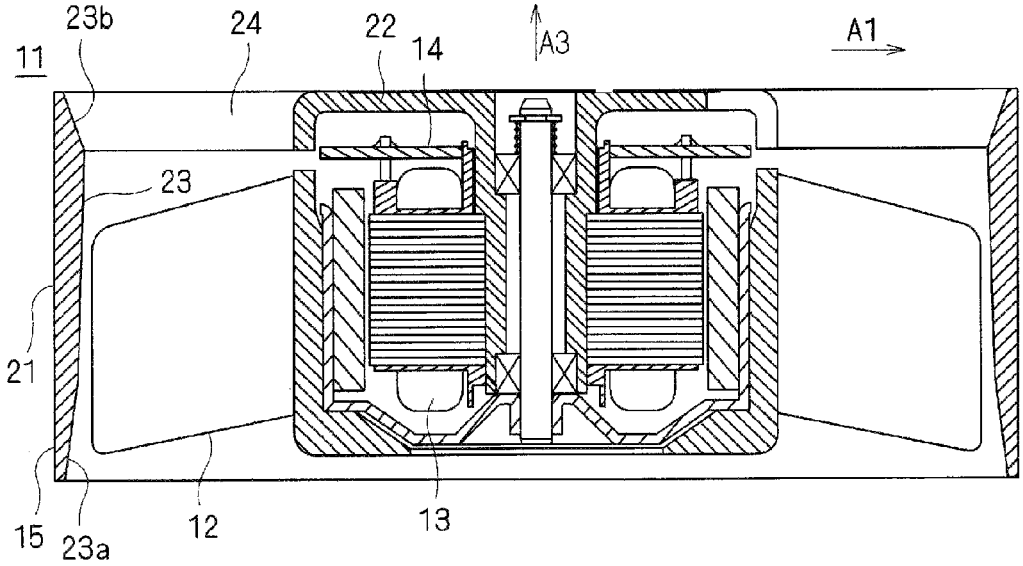
FIG. 2 is a schematic cross sectional view of the fan apparatus shown in FIG. 1.

FIG. 1 is a plan view of the fan apparatus according to a preferred embodiment of the present invention, while FIG. 2 shows a cross sectional view thereof. As shown in FIGS. 1 and 2, the fan apparatus 11 preferably includes an impeller 12, a motor portion 13, a circuit board 14 and a housing 15. The circuit board 14 includes a control circuit controlling a rotation of the impeller 12 by controlling a power distribution to the motor portion 13. The housing 15 accommodates therein the impeller 12, and supports the motor portion 13 and the circuit board 14.

Figure 3:
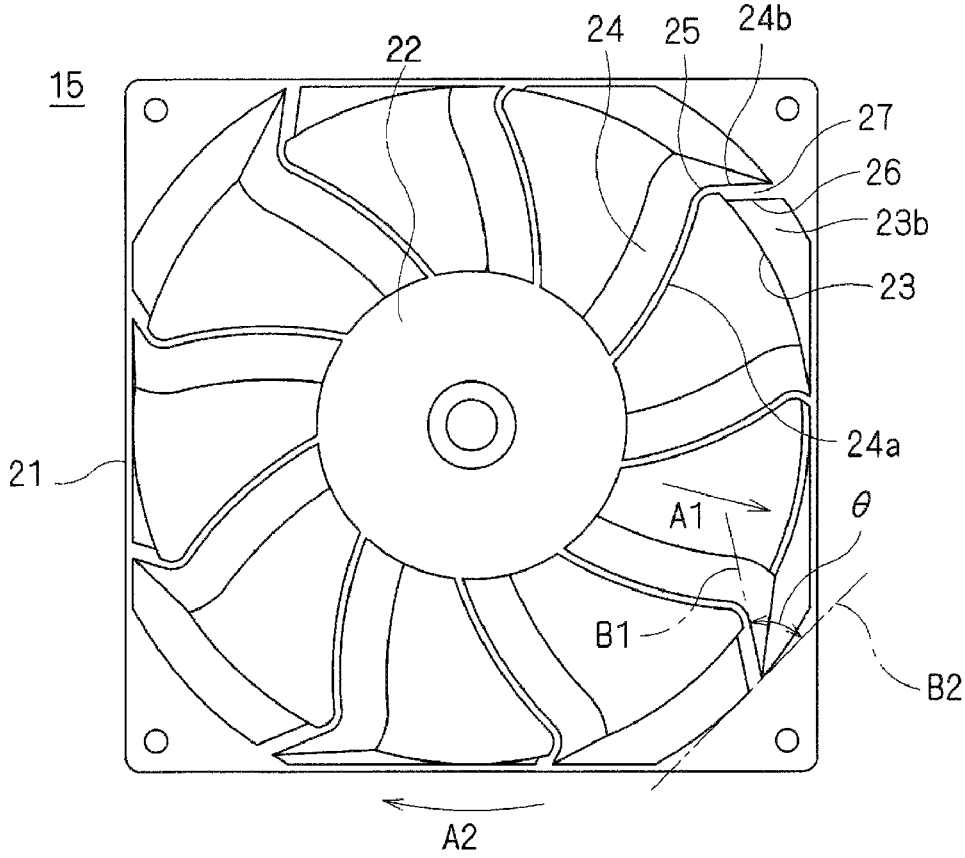
FIG. 3 is a schematic plan view of a housing of the fan apparatus shown in FIG. 1.

Also, as shown in FIG. 3, the housing 15 includes an outer frame portion 21 for surrounding and accommodating the impeller 12, and a plurality of stator blades 24. The stator blades 24 each having substantially a thin plate shape are arranged in a radial manner wherein one end of each stator blade 24 is attached to a support portion 22 arranged within the outer frame portion 21, while the other end is attached to an inner surface 23 of the outer frame portion 21. The outer frame portion 21 preferably has, when viewed from an axial end, a substantially square shape. The support portion 22 is arranged inside an opening defined within the outer frame portion 21 at an axial end from which an air flow is discharged, and supports the motor portion 13 and the circuit board 14. Each of the stator blades 24 adjusts a direction of the air flow (i.e., directing the air flow in a predetermined direction, and increasing static pressure) generated by a rotation of the impeller 12. Also, the stator blades 24 each support the support portion 22. A main function of the stator blades 24 is to direct the air flow. The stator blades 24 each are inclined with respect to an axial direction A3 (see FIG. 2).

The inner surface 23 of the outer frame portion 21 includes, in order to stabilize the air flow, inclined portions 23*a* and 23*b* at which the further a portion thereof in the axial direction is located, the further outwardly in a radial direction the portion becomes (see FIG. 2). A plurality of stator blades 24 (for example, 7 in the present preferred embodiment) are attached at one end thereof to corresponding inclined portions 23*b* arranged at the discharging end of the inner surface 23.

Figure 4:
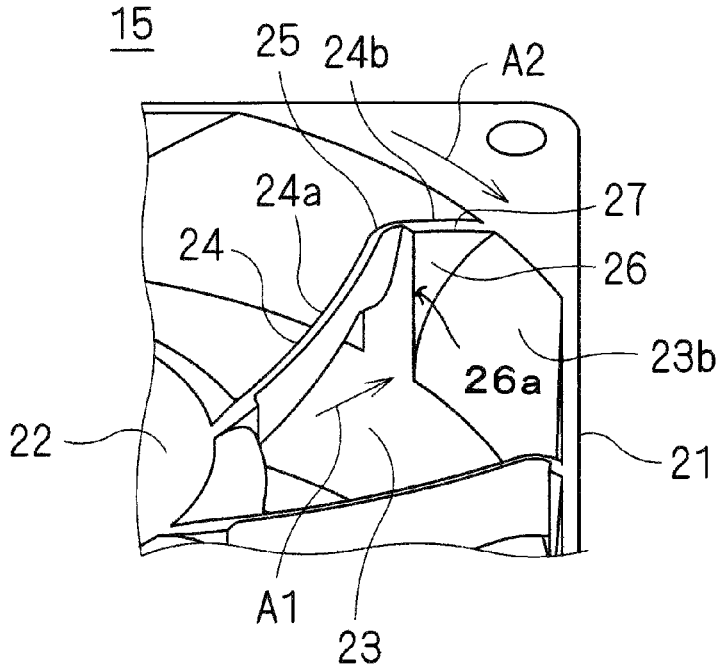
FIG. 4 is an enlarged perspective view of a portion of the housing shown in FIG. 3.

Also, each stator blade 24 includes a curved portion 25 at which a direction in which the stator extends is changed along a hypothetical surface that is substantially perpendicular to the axial direction. In particular, as shown in FIGS. 3 and 4, according to the present preferred embodiment of the present invention, the curved portion 25 is, when seen from an axial end, arranged preferably near a portion of the inclined portion 23*b* at the inner surface 23 nearest to a central axis. Also, a portion of each stator blade 24 arranged further inward toward the central axis than the curved portion 25 is veered toward a direction of the rotation of the impeller 12 (i.e., when seen from an axial end, the portion of the stator blade 24 nearer to the central axis is not pointing straight at the central axis from the curved portion 25), is arched toward the rotational direction of the impeller 12 and is inclined with respect to the axial direction A3. Furthermore, a portion of each stator blade 24 extending toward the outer frame portion 21 from the curved portion 25 is curved toward a rotational direction A2.

The housing 15 is preferably a single component made of a resin material including the outer frame portion 21, the support portion 22 and the plurality of stator blades 24. The housing 15 is preferably made by using the mold having the fixed mold portion and the sliding mold portion as described above wherein the sliding mold portion slides in the axial direction A3. Therefore, as shown in FIG. 4, the excessively bulging portion 26 will be generated inevitably near the inclined portion 23*b*.

Since each stator blade 24 is, at the curved portion 25 thereof, inclined with respect to the axial direction A3 such that, when viewed from one end of the axial direction, the width thereof is thinnest (i.e., the stator blade is substantially perpendicular along with the axial direction A3). Therefore, the characteristics concerning the flow quantity, wind speed distribution, and the degree of quietness will be improved.

In particular, a configuration of the housing 15 according to the present preferred embodiment of the present invention is characterized in that an angle θ (see FIG. 3) defined between the stator blade 24 at the portion thereof attached to the inner surface 23 and the inner surface 23 is considerably different from that defined between the corresponding portions of the configuration of a conventional housing. It is to be appreciated that the angle θ is measured at an intersection between a line B1 indicating a direction of radially outermost portion (24*b*) of the stator blade 24 and a line B2 indicating the direction of the inner surface 23.

Figure 6:
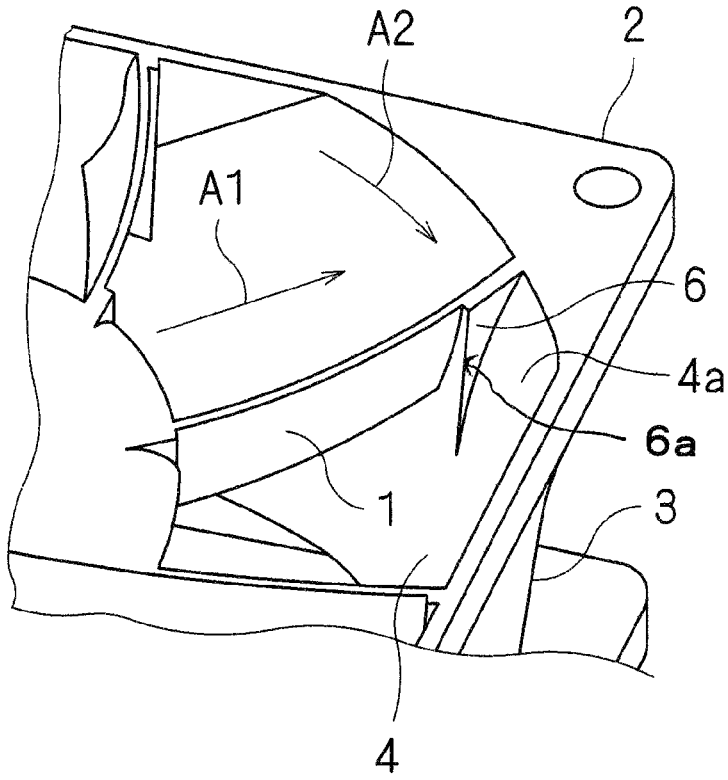
FIG. 6(PRIOR ART)
FIG. 6 is an enlarged perspective view of a portion in which a stator blade is arranged of the conventional fan apparatus.
Figure 7:
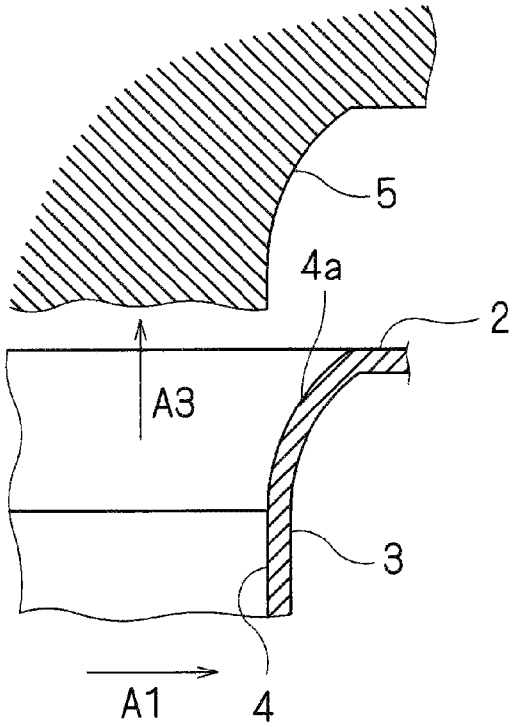
FIG. 7 (Prior Art)
FIG. 7 is a schematic cross sectional view of the portion shown in FIG. 6.

In particular, as shown in FIG. 6, a stator blade 1 is attached to an inner surface 4 of an outer frame portion 3 while the stator blade 1 still points toward a direction that is opposite of a rotational direction of the impeller. That is to say, according to the present preferred embodiment of the present invention, an inclination of the stator blade 24 with respect to the radial direction A1 at the portion where the excessively bulging portion 26 is located is entirely different from that of the conventional housing.

Therefore, due to restrictions imposed on the configuration of the mold used to form the housing 15 and the conventional housing, the configurations of the excessively bulging portion 26 located near the stator blades 24 and the areas surrounding the excessively bulging portion 26 according to the present preferred embodiment of the present invention are different from the configurations of the excessively bulging portion 6 located near the stator blades 1 and the areas surrounding the excessively bulging portion 6. By virtue of such a well-defined difference, compared with the conventional fan apparatus, the fan apparatus according to the present preferred embodiment of the present invention is better able to control the wind quantity, wind speed distribution and the degree of quietness, thereby improving the characteristics thereof. In particular, the stator blade 24 includes the curved portion 25 which is arranged at the portion near the inclined portion 23*b* having the smallest diameter at the inner surface 23. By virtue of such configuration, the air flow flowing through an opening of the fan apparatus is directed by a portion 24*a* of the stator blade 24 which is arranged radially inward of the curved portion 25 of the stator blade 24, is arched toward the direction opposite of the rotation of the impeller 12 and is inclined with respect to the axial direction A3. Also, regarding an air flow which passes through the portion near the inclined portion 23*b* and is most influenced by the excessively bulging portion 26, the stator blade 24 is inclined with respect to the rotational direction of the impeller 12, thereby minimizing an effect of the excessively bulging portion 26 has on the air flow.

Since a rotational component and a centrifugal force are imposed, respectively in the rotational direction A2 and the radial direction A1, on the air flow discharged from the fan apparatus via the impeller 12, the air flow is forced to spread in the radial direction A1 that is not parallel to the axial direction A3. Also the wind speed is, relatively speaking, greater for the air flow passing through an outer portion of the impeller 12 than that passing through an inner portion. Therefore, if the air flow passing though the outer portion of the impeller 12 is effectively controlled, the wind quantity and the degree of quietness will be improved.

In order to address the aforementioned phenomenon, the stator blade 24 according to the present preferred embodiment of the present invention is curved at the radially outward portion 24*b* toward the rotational direction A2. Therefore, the portion of the stator blade 24 radially outward of the curved portion 25 has minimum interference with the air flow passing therethrough. By virtue of such a unique configuration, an energy loss of the air flow will be minimized while the wind quantity and the degree of quietness will be improved compared with the fan apparatus according to the conventional configuration.

Also, the shape of the excessively bulging portion 26 is formed in conformity with the way in which the stator blade 24 is attached to the inner portion 23. In particular, as shown in FIG. 4, according to the present preferred embodiment of the present invention, a corner portion 26*a* (see FIG. 4) has an obtuse angle since the radially outward portion 24*b* is arched toward the rotational direction A2. On the other hand, as shown in FIG. 6, according to the conventional configuration, since the entire stator blade 1 is arched toward the direction opposite of the rotation direction A2, the angle of a corner portion 6*a* will be consequently acute.

By virtue of the difference in the configuration of the excessively bulging portion 6 and that of the excessively bulging portion 26, the present preferred embodiment of the present invention has an improved characteristic with respect to the degree of quietness. That is, when the corner portion 6*a* of the excessively bulging portion 6 has an acute angle as in the conventional configuration, a flow separation occurs when the air flow passes through the excessively bulging portion 6 and therefore, a desirable degree of quietness will be not be achieved. On the other hand, since the corner portion 6 of the excessively bulging portion 26 according to the present preferred embodiment of the present invention has an obtuse angle, the flow separation will be minimized when the air flow passes through the excessively bulging portion 26, and therefore, a desirable degree of quietness will be achieved.

Figure 5:
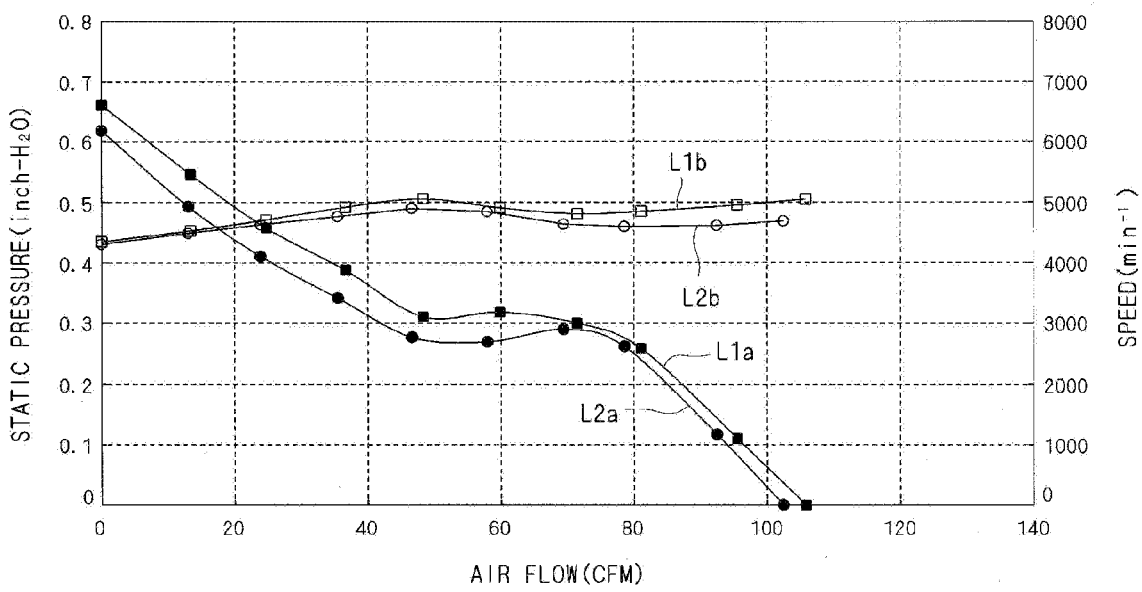
FIG. 5 is a graph showing a result of a simulation test conducted on the fan apparatus shown in FIG. 1 and that of a conventional fan apparatus.

FIG. 5 is a diagram showing a result of a measurement conducted on the fan apparatus 11 according to the present preferred embodiment of the present invention and that of the conventional fan apparatus shown in FIG. 6. Note that both fan apparatus 11 and the conventional fan apparatus have an impeller that is substantially identical to the impeller 12. Lines L1*a* and L1*b*, shown in the diagram, indicate a PQ characteristic and a speed of rotation of the impeller 12 according to the fan apparatus 11 according to the present preferred embodiment of the present invention when a noise level of an air flow generated by the impeller 12 is at 50 dBA. Lines L2*a* and L2*b*, shown in the diagram, indicate PQ characteristic and a speed of the rotation of the impeller 12 according to the conventional fan apparatus when a noise level of an air flow generated by the impeller 12 is at 50 dBA. Hereinafter, the PQ characteristic indicates the characteristic of the fan apparatus based on a correlation between static pressure and flow quantity thereof.

As clearly indicated in FIG. 5, when the fan apparatus according to the present preferred embodiment of the present invention and the conventional fan apparatus are operated so as to generate the same noise level, a higher value for static pressure is obtained by the fan apparatus 11 at any flow quantity. Also, the fan apparatus 11 can operate at a higher rotation speed than the conventional fan apparatus. That is to say, when the impeller 12 is used, smaller values are obtained by the stator blade 24 according to the present preferred embodiment of the present invention compared with the conventional stator blade as shown in FIG. 6.

Note that although the excessively bulging portion 26 is described as a portion generated due to the restriction imposed on the direction in which the sliding mold portion is moved with respect to the fixed mold portion while forming the stator blade 24, from a stand point of strengthening the mold, a broad surface portion 27 see FIGS. 3 and 4) may be included at the excessively bulging portion 26.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan apparatus comprising:

an impeller;

a motor arranged to rotate with respect to a central axis in a concentric manner with the impeller;

a plurality of stator blades arranged in a substantially radial direction opposite from the impeller in an axial direction; and a support portion connected to the stator blades; wherein each of the stator blades includes a curved portion extending in the radial direction;

a direction in which each stator blade extends changes at the curved portion thereof along a hypothetical surface that is substantially perpendicular to the axial direction such that a first portion of each stator blade arranged adjacent to the support portion extends in a different circumferential direction than that of a second portion of each stator blade arranged adjacent to the curved portion; and the first portion of each stator blade veers towards a direction that is opposite to a rotational direction of the impeller with respect to the central axis.

2. The fan apparatus according to claim 1, wherein the first portion of each stator blade is arched toward the rotational direction of the impeller.

3. The fan apparatus according to claim 1, wherein the first portion of each stator blade is inclined with respect to the axial direction.

4. The fan apparatus according to claim 1, wherein the second portion of each stator blade is inclined toward a rotational direction of the impeller.

5. The fan apparatus according to claim 1, wherein the curved portion of the stator blade is arranged at a portion thereof further away from the central axis than a radially central portion of the stator blade.

6. The fan apparatus according to claim 1, further comprising a housing arranged to accommodate therein the impeller and to support the motor, wherein the housing includes an outer frame portion having a substantially square shape arranged to surround and accommodate therein the impeller, the outer frame portion includes at an inner surface thereof an inclined portion at which a space defined within the inner surface is increased toward axial ends, and each of the stator blades is arranged to connect the support portion of the housing and the inclined portion.

7. The fan apparatus according to claim 6, wherein the curved portion of each stator blade is arranged near a portion of the inclined portion nearest to the central axis.

8. The fan apparatus according to claim 6, wherein the housing and each stator blade are made of resin and made by a mold as a single component.

9. The fan apparatus according to claim 6, wherein the housing has an excessively bulging portion formed during molding of the housing, and the excessively bulging portion has a corner portion that has an obtuse angle.

10. A fan apparatus comprising:

an impeller arranged to take in, when the impeller rotates, air from one end of an axial direction and discharge the air from the other axial end;

a motor arranged to rotate in a concentric manner with the impeller with respect to a central axis;

a housing including an outer frame portion surrounding the impeller, and a support portion arranged at said axial end to support the motor; and a plurality of stator blades arranged in substantially a radial direction opposite from the said axial end; wherein each of the stator blades is arranged to connect the support portion and the outer frame portion, and each of the stator blades includes a curved portion extending in the radial direction;

a portion at which the stator blade and the support portion are connected to one another is inclined toward a direction of the rotation of the impeller;

a direction in which each stator blade extends changes at the curved portion thereof along a hypothetical surface that is substantially perpendicular to the axial direction such that a first portion of each stator blade arranged adjacent to the support portion extends in a different circumferential direction than a second portion of each stator blade arranged adjacent to the curved portion; and the first portion of each stator blade veers towards a direction that is opposite to a rotational direction of the impeller with respect to the central axis.

11. The fan apparatus according to claim 10, wherein the housing and each stator blade are made of resin and made by a mold as a single component.

12. The fan apparatus according to claim 10, wherein the housing has, when viewed axial direction, a substantially rectangular shape including at four corners therein the inclined portion.

13. The fan apparatus according to claim 10, wherein the first portion of each stator is arched toward the rotational direction of the impeller.

14. The fan apparatus according to claim 10, wherein the first portion of each stator blade is inclined with respect to the axial direction.

15. The fan apparatus according to claim 10, wherein the curved portion of the stator blade is arranged at a portion thereof further away from the central axis than a radially central portion of the stator blade.

16. The fan apparatus according to claim 10, wherein the outer frame portion includes at an inner surface thereof an inclined portion at which a space defined within the inner surface is increased toward axial ends, and each of the stator blades is arranged to connect the support portion of the housing and the inclined portion.

17. The fan apparatus according to claim 10, wherein the housing has an excessively bulging portion formed during molding of the housing, and the excessively bulging portion has a corner portion that has an obtuse angle.

* * * * *